US005937542A

United States Patent [19]

Bourdeau

[11] Patent Number: 5,937,542

[45] **Date of Patent: *Aug. 17, 1999**

[54] INTERNAL LINER FOR A SPORT BOOT

[75] Inventor: Joël Bourdeau, Saint-Jorioz, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,566

[22] PCT Filed: Nov. 27, 1996

[86] PCT No.: PCT/FR96/01875

§ 371 Date: Aug. 26, 1997

§ 102(e) Date: Aug. 26, 1997

[87] PCT Pub. No.: WO97/24040

PCT Pub. Date: Jul. 10, 1997

[30] Foreign Application Priority Data

Dec. 27, 1995 [FR] France ..... 95 15810

[51] Int. Cl.[6] ..... A43B 5/04

[52] U.S. Cl. ..... 36/10; 36/50.5; 36/84; 36/9 R

[58] Field of Search ..... 36/10, 50.5, 50.1, 36/58.5, 58.6, 84, 9 R, 117.6

[56] References Cited

U.S. PATENT DOCUMENTS

| | | |
|---|---|---|
| 601,234 | 3/1898 | Blossom . |
| 812,443 | 2/1906 | Wilde . |
| 2,124,310 | 7/1938 | Murr, Jr. . |
| 2,741,039 | 4/1956 | Mathews . |
| 3,456,366 | 7/1969 | Boeing . |
| 4,107,857 | 8/1978 | Devlin . |
| 4,458,373 | 7/1984 | Maslow . |
| 4,513,520 | 4/1985 | Koch . |
| 5,172,495 | 12/1992 | Fehlhaber et al. . |
| 5,174,050 | 12/1992 | Gabrielli . |
| 5,184,378 | 2/1993 | Batra . |
| 5,353,524 | 10/1994 | Brier . |
| 5,433,987 | 7/1995 | Peterson et al. . |
| 5,509,217 | 4/1996 | Condini . |
| 5,647,149 | 7/1997 | Dalebout . |

FOREIGN PATENT DOCUMENTS

| | | |
|---|---|---|
| 43885 | 2/1931 | Denmark . |
| 0657116 | 6/1995 | European Pat. Off. . |
| 657116 | 6/1995 | European Pat. Off. . |
| 1087129 | 2/1955 | France . |
| 919088 | 10/1954 | Germany . |
| 4129270 | 3/1993 | Germany . |
| 141463 | 4/1920 | United Kingdom . |

*Primary Examiner*—Ted Kavanaugh
*Attorney, Agent, or Firm*—Greenblum & Bernstein, P.L.C.

[57] ABSTRACT

A foot covering liner for a sport boot. The liner includes a sole, an upper, and a tightening device to tighten the liner on the foot. The sole and the liner of the liner are made of materials having a low resistance to tensile stress. Further, the tightening device surrounds at least a portion of the liner and is arranged outside thereof. The tightening device surrounding the liner includes at least one strap, the position of the ends of which can be adjusted with respect to one another.

23 Claims, 1 Drawing Sheet

INTERNAL LINER FOR A SPORT BOOT

This application is a 371 of PCT/FR96/01875 filed on Nov. 27, 1996.

BACKGROUND OF THE INVENTION

1. Field of the Invention

The invention relates to boots and more particularly concerns an internal liner for a sport boot.

2. Description of Background and Relevant Information

Certain sports, such as walking, gliding or rolling sports require that a user utilizes boots having an internal lining; that is the case for hiking, skiing, snowboarding, roller skating, cycling.

The liner used within a boot must perform one or more basic functions, such as shock absorption, distribution or evacuation of humidity, thermal insulation, management of comfort of the user's foot and/or lower part of the leg, etc.

To perform this(these) basic function(s), the liner must be kept in contact with the foot. Generally, liners are made of foams of plastic materials, woven fabrics, layers of plastic materials or rubber, or of combinations of these materials. The liners thus made have a sufficient tensile strength, such that tightening means can bring flaps of the upper closer to one another and to tighten the liner around the foot.

An example is given in the document DE 919 088 which proposes a liner including a sole, an upper and means for tightening the liner on the foot. These tightening means include textile strips affixed to the sole or to the upper, a lace making it possible to exert tensile stresses on the strips to bring flaps of the upper closer to one another and to tighten the liner on the foot.

The necessity for the liner to have an upper and a sole that are sufficiently resistant to tensile stresses is a limitation for the choice of materials. It is not possible, with the known conventional liners, to select materials that might perform the basic functions better, but are not mechanically very resistant.

SUMMARY OF THE INVENTION

One of the objects of the invention is to eliminate these problems of tensile strength in a liner that is made of the best materials.

Another object of the invention is to obtain a satisfactory tightening, on the foot and/or the lower part of the leg, of a liner made with materials that are not mechanically very resistant.

Yet another object of the invention is to propose an easy and inexpensive construction of the liner.

To this end, the invention proposes a liner for covering a foot which includes a sole and an upper, a tightening means making it possible to tighten the liner on the foot. The liner according to the invention is characterized in that the sole and the upper are made out of materials with low resistance to tensile stresses, and in that the tightening means surrounds at least a portion of the liner by being arranged outside thereof.

This arrangement makes it possible to separate the tightening function for keeping the liner in contact with the foot from the other functions performed by the liner. One advantage of this arrangement is the possibility of using high performance materials to ensure any basic function of the liner independently of its tightening on the foot.

According to a preferred arrangement, the tightening means surrounding the liner according to the invention includes at least one strap whose ends can be positioned with respect to one another by a positioning means. Each strap makes it possible to uniformly distribute a tightening force around the foot. It follows advantageously that any point stress is eliminated.

Still preferably, each strap of the liner is at least partially movable with respect to the liner in a direction of tightening or loosening of the foot. Therefore, the strap can slide with respect to the liner, which advantageously reduces the friction of the liner on the foot and prevents any point deformation of the liner.

BRIEF DESCRIPTION OF THE INVENTION

Other characteristics and advantages of the invention will be better understood along the description that follows, with reference to the annexed drawing illustrating, by way of a non-limiting example, how the invention can be embodied, and in which.

DETAILED DESCRIPTION OF THE INVENTION

Figure 1:
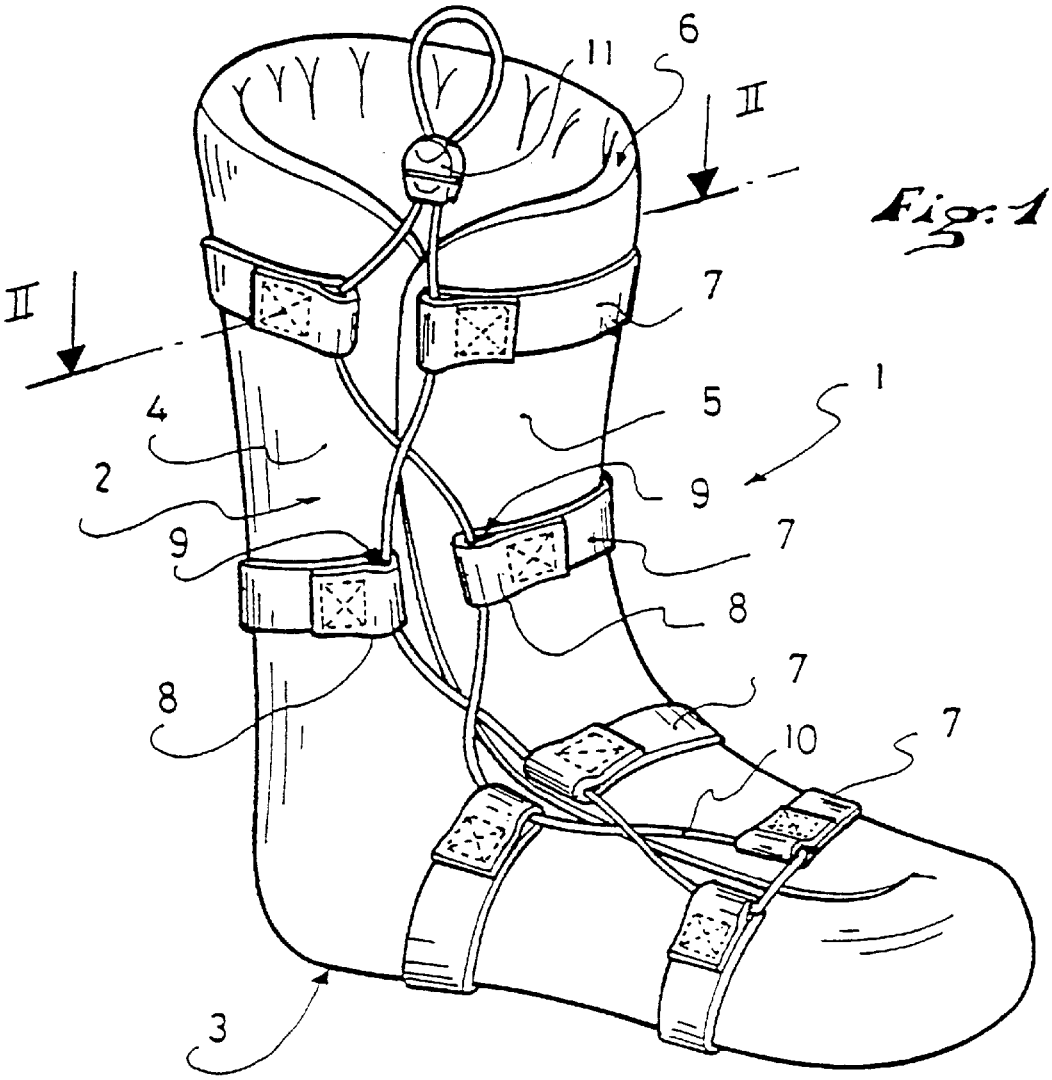
FIG. 1 is a perspective view of a liner according to the invention.

A liner 1 shown in perspective in FIG. 1 is provided to be inserted within a shell, not shown, to form a sport boot. The liner 1 includes an upper 2 affixed to a sole 3, the upper 2 comprising two flaps 4, 5, that are movable with respect to one another. As shown in the figures, the upper 2 and the sole 3 are formed in a monoblock, or unitary, construction.

The liner 1 is adapted to surround the foot and the lower part of the leg of a user by performing basic functions such as shock absorption, distribution or evacuation of humidity, thermal insulation, comfort or the like.

Figure 2:
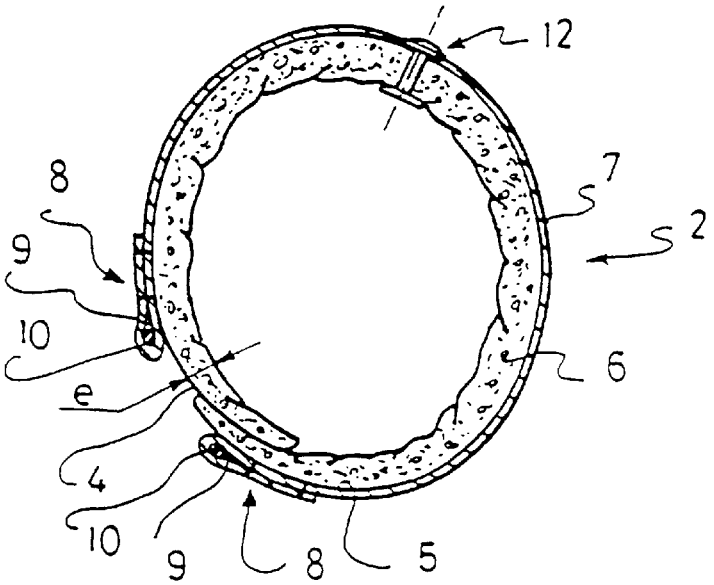
FIG. 2 is a cross section along II—II of FIG. 1.

As shown in the cross section in FIG. 2, the upper 2 is made of a layer of materials of a certain thickness e. Preferably, the sole 3 has a structure that is similar to that of the upper 2. The thickness e is a non-woven pad 6 of fibers oriented with respect to one another in any direction.

The fibers can be held together by mechanical effect if they have been subjected to high pressures which generate their natural cohesiveness. The fibers can also be connected by melting with hot-melt fibers.

Finally, the fibers can also be affixed by heat-sealing due to the addition of resins.

The fibers are selected in various categories as a function of the specific properties that one wishes to provide the liner with.

For example, animal fibers such as wool, mohair wool, alpaca, cashmere, camel hair, fur, or silk generally ensure a good thermal insulation and protection against friction.

Certain mineral fibers, such as glass or metal fibers, can be integrated into the pad 6 to modify its mechanical strength.

Synthetic fibers that are textile materials of chemical origin, such as polyamides, polyesters or acrylics, make it possible to manage the distribution or evacuation of humidity. Indeed, these fibers are hydrophobic.

Vegetable fibers, such as kapok, sisal, linen or hemp, also make it possible to manage the distribution of humidity.

The fibers are generally a few centimeters long. They are selected to form a mixture whose proportions provide the liner 1 with the ability to perform the basic functions selected by the manufacturer.

The liner 1 obtained using the fibers and methods explained has a relatively low mechanical strength with respect to the conventional liners.

As shown in FIG. 1, a means for tightening the liner 1 on the foot is arranged outside the liner 1. The tightening means is shown in the form of four straps 7 which surround the upper 2 at least partially, or both the sole 3 and the upper 2 at the same time. Each strap has two ends 8, each end 8 being folded over itself and stitched to form a passage 9. A positioning means makes it possible to control the distance separating the two ends 8 of a same strap 7. This positioning means is shown here in the form of a lace 10 associated with a lace retention device which can be a clamp 11.

The lace 10 successively extends through each passage 9 of the ends 8 of the straps 7, by running alternately from one passage 9 of one strap 7 located on one of the flaps 4, 5, to another passage 9 of a successive strap 7 located on the other flap 4,5. The progress of the lace 10 thus occurs through alternating overlapping of the flaps 4 and 5 of the upper 2. The clamp 11 makes it possible to adjust the length of the lace 10 which extends through the passages 9. When this length diminishes, the ends 8 of the straps 7 come closer together and increase the tightening of the liner 1 on the foot. Conversely, when this length increases the tightening is reduced proportionally. The limit is reached when the length of the lace 10 which extends through passages 9 is maximum. In this case, the ends 8 of the straps 7 can move sufficiently away from one another to enable the fitting or removal of the liner 1.

Preferably, each strap 7 is capable of sliding on the upper 2 and on the sole 3 of the liner 1 to prevent stresses of the pad 6 that could occur in the direction of the fibers by pulling unduly on the straps 7. Conversely, the liner 1 withstands very well the compression stresses due to the tightening by the straps 7 or to contacts with the shell, because these are stresses that go in a direction substantially perpendicular to the fibers of the pad 6.

To tighten the liner 1 by means of the straps 7 in preferred areas of the foot, each strap 7 is preferably retained in a tightening zone of the liner 1, in contact with the pad 6, by a means for retaining the strap 7 shown in FIG. 2 in the form of a rivet 12. The relative mobility of the pad 6 and of a strap 7 is not reduced by the presence of the rivet in a direction of tightening. One end 8 can slide on the flap 4, whereas the other end 8 can slide on the flap 5.

The liner thus obtained enables easy and quick fitting and removal of the boot.

Of course, the invention is not limited to the embodiment thus described, and it includes all the technical equivalents that fall within the scope of the claims that follow.

In particular, one can provide to cover at least one of the surfaces of the pad 6 with a thin film of plastic material.

One can also change the number of straps, replace the folds and stitches by eyelets, or else place a lace for each strap 7 to tighten the liner 1.

One can also make a liner 1 with a monoblock uppers without flap 4, 5.

I claim:

1. A liner constituting an inner boot adapted to be fitted within a sport boot, said liner comprising:

a sole and an upper extending upwardly from said sole, said sole and said upper being made of materials having a low resistance to tensile stress; and a tightening device to tighten the liner on the foot of a wearer, said tightening device surrounding at least a portion of an exterior of the liner.

2. A liner according to claim 1, wherein:

said sole and said upper are formed as unitary.

3. A liner according to claim 1, wherein:

said tightening device surrounding said liner comprises:

at least one strap having ends; and a positioning device to position said ends of said strap with respect to one another.

4. A liner according to claim 3, wherein:

said at least one strap comprises four straps.

5. A liner according to claim 3, wherein:

at least said upper comprises a pad of non-woven fibers.

6. A liner according to claim 5, wherein:

said fibers are mechanically held together by having been subjected to high pressures.

7. A liner according to claim 5, wherein:

said fibers are mechanically held together with melted hot-melt fibers.

8. A liner according to claim 5, wherein:

said pad of non-woven fibers are heat-sealed with a resin.

9. A liner according to claim 5, wherein:

said fibers include animal fibers.

10. A liner according to claim 5, wherein:

said fibers include vegetable fibers.

11. A liner according to claim 5, wherein:

said fibers include mineral fibers.

12. A liner according to claim 11, wherein:

said mineral fibers include at least one of glass fibers and metal fibers.

13. A liner according to claim 5, wherein:

said fibers include synthetic fibers.

14. A liner according to claim 13, wherein:

said synthetic fibers include at least one of polyamide fibers, polyester fibers, and acrylic fibers.

15. A liner according to claim 5, wherein:

at least one surface of said pad of non-woven fibers is covered with a thin film of plastic material.

16. A liner according to claim 1, wherein:

each of said at least one strap is retained in a tightening zone of said liner by a means for retaining said strap to said liner.

17. A liner according to claim 1, wherein:

said upper comprises at least two flaps, said two flaps being movable with respect to one another.

18. A liner according to claim 1, wherein:

said upper comprises at least two overlapped flaps, said overlapped flaps being movable with respect to one another.

19. A liner according to claim 1, wherein:

said sole and upper comprise a pad of non-woven fibers.

20. A liner adapted to be fitted within a sport boot, said liner comprising:

a sole and an upper extending upwardly from said sole, said sole and said upper being made of materials having a low resistance to tensile stress; and a tightening device to tighten the liner on the foot of a wearer, said tightening device surrounding at least a portion of an exterior of the liner, said tightening device surrounding said liner comprising:

at least one strap having ends, each of said at least one strap being retained in a tightening zone of said liner by a means for retaining said strap to said liner; and a positioning device to position said ends of said strap with respect to one another;

wherein each of said at least one strap has at least a portion non-attached attached to said liner to enable sliding movement with respect to said liner in a first direction effecting tightening of said liner on the foot and in a second direction effecting loosening of said liner on the foot.

21. A liner adapted to be fitted within a sport boot, said liner comprising:

a sole and an upper extending upwardly from said sole, said sole and said upper being made of materials having a low resistance to tensile stress; and a tightening device to tighten the liner on the foot of a wearer, said tightening device surrounding at least a portion of an exterior of the liner, said tightening device surrounding said liner comprising:

at least one strap having ends; and a positioning device to position said ends of said strap with respect to one another, said positioning device comprising:

at least one lace operatively connected to said ends of said at least one strap; and a lace retention device to retain the lace in a position with respect to said ends of said at least one strap.

22. A liner constituting an inner boot adapted to be fitted within a sport boot, said liner comprising:

a sole and an upper extending upwardly from said sole, said sole and said upper comprising means for having a low resistance to tensile stress; and a tightening device to tighten the liner on the foot of a wearer, said tightening device surrounding at least a portion of an exterior of the liner.

23. A liner constituting an inner boot adapted to be fitted within a sport boot, said liner comprising:

a sole and an upper extending upwardly from said sole, said sole and said upper comprising a pad of non-woven fibers, said pad having a low resistance to tensile stress; and a tightening device to tighten the liner on the foot of a wearer, said tightening device surrounding at least a portion of an exterior of the liner.

* * * * *